US006557748B2

(12) United States Patent
Bethke

(10) Patent No.: US 6,557,748 B2
(45) Date of Patent: May 6, 2003

(54) REVERSE ECCENTRIC DOUBLE PARALLEL PRESSURE SEAL BUSINESS FORM

(75) Inventor: Darvin R. Bethke, Forest Lake, MN (US)

(73) Assignee: Moore North America, Inc., Grand Island, NY (US)

( * ) Notice: Subject to any disclaimer, the term of this patent is extended or adjusted under 35 U.S.C. 154(b) by 0 days.

(21) Appl. No.: 09/922,717

(22) Filed: Aug. 7, 2001

(65) Prior Publication Data

US 2003/0034384 A1 Feb. 20, 2003

(51) Int. Cl.[7] ..... B65D 27/06

(52) U.S. Cl. ..... 229/92.1; 229/70; 229/305; 283/57

(58) Field of Search ..... 229/305, 306, 229/92.1, 92.3, 70; 283/57

(56) References Cited

U.S. PATENT DOCUMENTS 821,723 A * 5/1906 Lord ..... 229/92.3
830,354 A * 9/1906 McDonald ..... 229/92.3
5,598,970 A * 2/1997 Mudry et al. ..... 229/300
5,642,855 A * 7/1997 Michlin ..... 229/305
5,752,647 A * 5/1998 Schubert et al. ..... 229/300
6,123,253 A * 9/2000 Mehta et al. ..... 229/305
6,422,938 B1 * 7/2002 Steitz ..... 229/92.1

* cited by examiner

*Primary Examiner*—Jes F. Pascua
(74) *Attorney, Agent, or Firm*—Nixon & Vanderhye P.C.

(57) ABSTRACT

A mailer type business form, including: first, second, third and fourth panels defining a sheet prior to folding the form, the first, second and third panels being substantially the same size and shape and being interconnected at first and second panel fold lines in a manner that enables the first, second and third panels to be z-folded onto each other. The first panel includes outgoing address indicia on a lower portion of the front surface of the first panel. The fourth panel is interconnected to the third panel at a third fold line, and the fourth panel is shorter than the first panel by an amount that causes the fourth panel to extend to a location that is just slightly above the outgoing address indicia on the first panel when folded against the first panel.

18 Claims, 9 Drawing Sheets

(Front for Return Envelope Embodiment with Detachable Return Stub)

(Front for Return Envelope Embodiment with Attached Return Stub)

(Back for Return Envelope Embodiment with Attached or Detached Return Stub)

(Front for Non-Check Embodiment)

(Front for Check Embodiment)

(Front for 180° Rotated Check Embodiment)

(Back for Check, Non-Check and 180° Rotated Embodiments)

REVERSE ECCENTRIC DOUBLE PARALLEL PRESSURE SEAL BUSINESS FORM

FIELD OF THE INVENTION

The instant invention relates to mailer-type business forms and the like, and more particularly, to a reverse eccentric double parallel pressure seal form which provides an increased amount of customer printed variable space.

BACKGROUND AND SUMMARY OF THE INVENTION

Various mailer-type business forms have been provided in the past as evidenced by, for example, U.S. Pat. Nos. 5,375,764; 4,928,875; 5,201,464; 5,314,110; 5,346,123; 5,366,145; 5,370,304; 5,553,774; 6,622,390; 5,785,242; 6,015,085 and 5,513,795, each of which is incorporated be reference herein in its entirety.

While these and other prior art business forms have proven to be useful and convenient for many applications, further improvements in such forms are still desired. For example, increasing the space that is available on the forms for customer printed variable information in an easy, inexpensive and efficient manner would significantly improve such forms for many applications. More particularly, it would be advantageous to maximize the space that is available on mailer-type business forms for use in printing information or providing detachable elements that relate to the mailer. Various types of mailer type business forms could use improvements in the manner in which the are laid out and configured, for the purpose of providing a mailer that is easy to assemble (e.g., fold) into a form that can be easily mailed in connection with a business activity or the like, while also providing a large amount of space for printing thereon.

Mailer-type forms also require that the form be configured such that, when it is folded, the form includes an outgoing address and return address in a manner that generally corresponds to a conventional letter. Some mailer-type forms have also been designed in the past to include an integral return envelope that can be used by the recipient of the mailer for replying to the mailer, such as, for example, to send a check back to the sender of the mailer upon receipt thereof. The reply envelope is constructed as part of the form in a manner that enables the reply envelope to be removed from the mailer and resealed prior to mailing the envelope back to the original sender or other party. Such mailer-type forms have also included an integral return check stub for filling out and returning with a check, and/or a customer receipt that can be removed from the mailer and kept by the recipient as a record of the transaction. Mailer type forms have also been used to provide a check to the recipient, together with information relating to the check, such as a check statement.

Mailer-type business forms have a variety of applications and come in a variety of forms. As indicated above, such forms may include a return envelope, detachable or attached stubs, detachable receipts, and/or detachable checks. Such mailer forms have also come in a non-check and non-return envelope configuration that is designed to act simply as a mailer with customer printed variable data thereon. Such forms have been provided in a cut sheet format, a continuous fan-fold format as well as other formats.

The instant invention is designed to improve all of the types of mailer-type business forms discussed above, as well as other similar mailer-type forms, by improving the available space on the forms for printing application specific or customer defined information. In other words, the instant invention provides an improved design and configuration for mailer-type business forms.

In accordance with the invention, the mailer form includes four main panels, three of which are substantially the same size and shape and are configured to be z-folded. An outgoing address for the mailer is printed at the bottom of the lower one of the three panels (i.e., at the bottom of the form prior to folding) at a location that begins approximately 1.125 inches from the bottom of the form. The fourth panel, which constitutes a double parallel external panel, is designed to fold over the z-folded first three panels such that the outgoing address on the z-folded portion is still visible. In other words, the fourth panel is shorter than the z-folded panels, thereby enabling the fourth or front external panel to leave the outgoing address visible on the z-folded portion of the form when folded thereon. In order to maximize the space for enabling printing on the form, the fourth panel is preferably designed such that it extends to a position that is approximately 1.125 inches short of the bottom of the form, thereby making the fourth panel as large as possible without covering the outgoing address on the form. A return address and postal stamp portion may also be printed on the back of the fourth panel such that the final folded form includes both an outgoing address, a return address and a postal stamp portion, thereby enabling the form to look similar to a conventional letter-type mailer that can be easily mailed in accordance with conventional postal procedures and requirements.

In accordance with a first aspect of the invention, a mailer type business form is provided which includes: first, second, third and fourth panels defining a sheet prior to folding the form, each of the panels having a front and back surface. The first, second and third panels are substantially the same size and shape and are interconnected at first and second panel fold lines in a manner that enables the first, second and third panels to be z-folded onto each other. The first panel includes outgoing address indicia on a lower portion of the front surface of the first panel, wherein the lower portion constitutes at least part of a visible portion of a front face of the mailer form when the form is folded and ready for mailing. The fourth panel is interconnected to the third panel at a third fold line, and the fourth panel is shorter than the first panel by an amount that causes the fourth panel to extend to a location that is just slightly above the outgoing address indicia on the first panel when folded against the first panel. When folded for mailing, the back surface of the fourth panel and the lower portion of the first panel define the front face of the mailer form. Adhesive is provided on the mailer form for removably holding the fourth panel against the first panel when the fourth panel is folded onto the first panel.

In accordance with another aspect of the invention, the lower portion of the first panel encompasses approximately the lower 1.125 inches of the first panel.

In accordance with another aspect of the invention, the first, second, third and fourth panels define a sheet prior to folding the form, and the first panel fold line is approximately 10.2 inches from the top of the sheet, the second panel fold line is approximately 6.5 inches from the top of the sheet, and the third fold line is approximately 2.4 inches from the top of the sheet.

BRIEF DESCRIPTION OF THE DRAWINGS

These and other features, objects and advantages of the instant invention will become apparent from the following detailed description when read in conjunction with the appended drawings, in which.

DETAILED DESCRIPTION OF THE PREFERRED EMBODIMENTS

The preferred embodiment of the instant invention will now be described with reference to the figures. These embodiments are only exemplary embodiments and are not meant to limit the invention to the particular features thereof, other than as expressly indicated in the appended claims.

Figure 1:
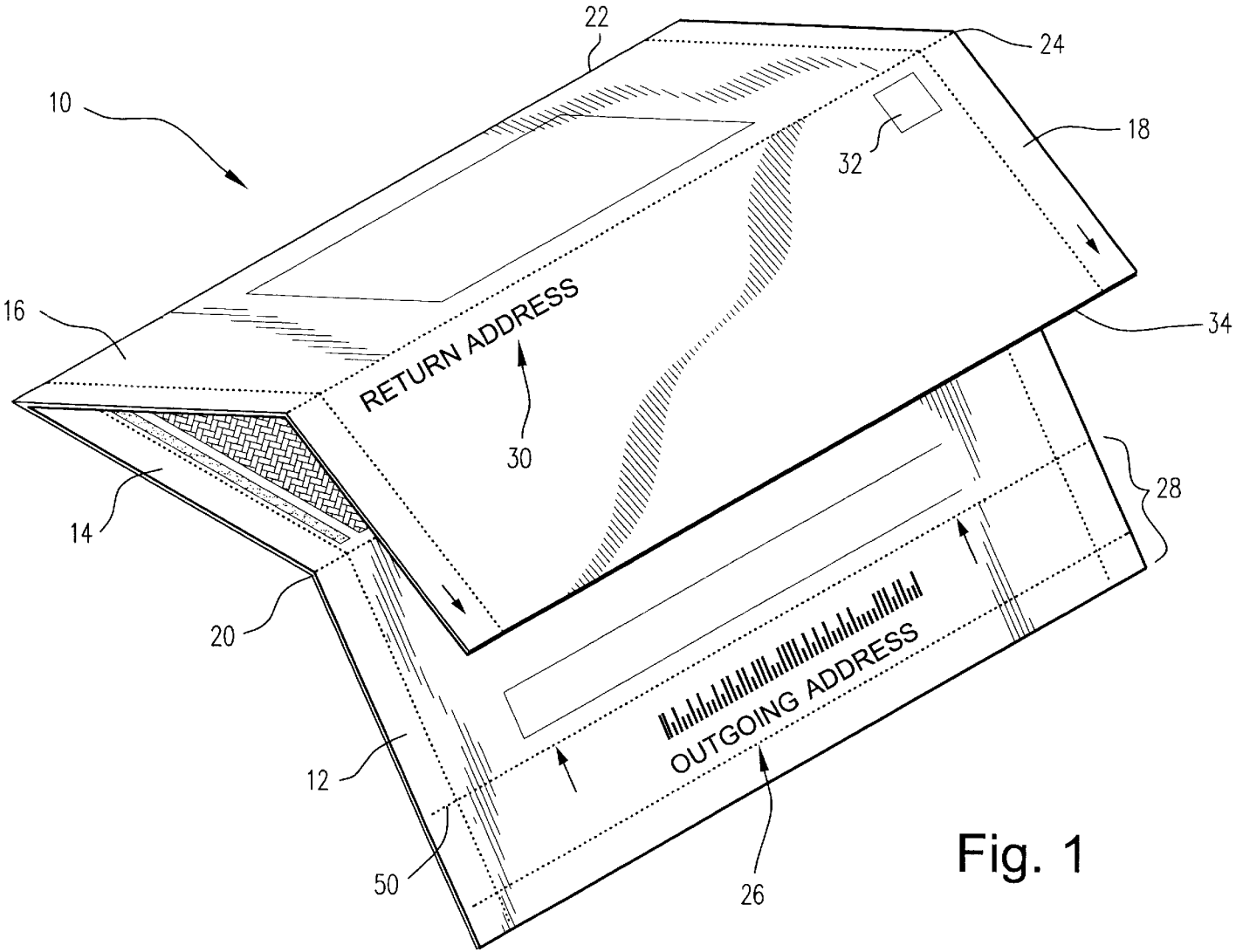
FIG. 1 is a perspective view of a preferred embodiment of the instant invention which shows the form being folded into the configuration shown in FIG. 2.

FIG. 1 shows a perspective view of one embodiment of the instant invention which shows how the mailer form 10 of the instant invention is folded for mailing. The form 10 includes four main panels 12, 14, 16 and 18. Panels 12, 14 and 18 are substantially the same size and shape. A first panel fold line 20 is provided between the first panel 12 and second panel 14. This fold line 20 enables the second panel 14 to fold flat against the first panel 12. A second panel fold line 22 is provided between the second panel 14 and the third panel 16. This second fold line 22 enables the third panel 16 to fold flat against the second panel 14. Thus, in accordance with this embodiment of the present invention, the first three panels (12, 14 and 16) and the two fold lines 20 and 22 enable this portion of the form 10 to be easily and neatly folded in a z-fold configuration.

In accordance with the invention, the fourth panel 18 is shorter than the first panel 12. A third fold line 24 is provided between the third panel and the fourth panel. This third fold line 24 enables the fourth panel to fold onto the front of the first panel when the other three panels have been z-folded, as indicated above. As shown in FIG. 1, the front surface of the first panel 12 has a lower portion 28 that includes outgoing address indicia 26 (human and/or machine readable). The length of the fourth panel 18 is selected such that it extends to a location on the first panel that is substantially equal to a location where the lower portion containing the outgoing address begins. With reference to FIG. 1, the length of the fourth panel 18 is such that it extends from the top of the first panel 12 to line 50, i.e. just above the lower portion of the first panel that displays the outgoing address 26. In other words, the free end 34 of the fourth panel meets the first panel along line 50. As a result, the lower portion and outgoing address remain visible when the fourth panel 18 is folded onto the first panel 12.

The back of the fourth panel also includes return address indicia 30 and a location for a postal stamp 32. Thus, when the fourth panel is folded onto the first panel the back surface of the fourth panel (with the return address and postal info) is visible, together with the outgoing address information on the lower portion of the first panel. In other words, the front face 36 the final folded mail form is defined by the back surface of the fourth panel 18 and the front surface of the lower portion 28 of the first panel 12.

Figure 2:
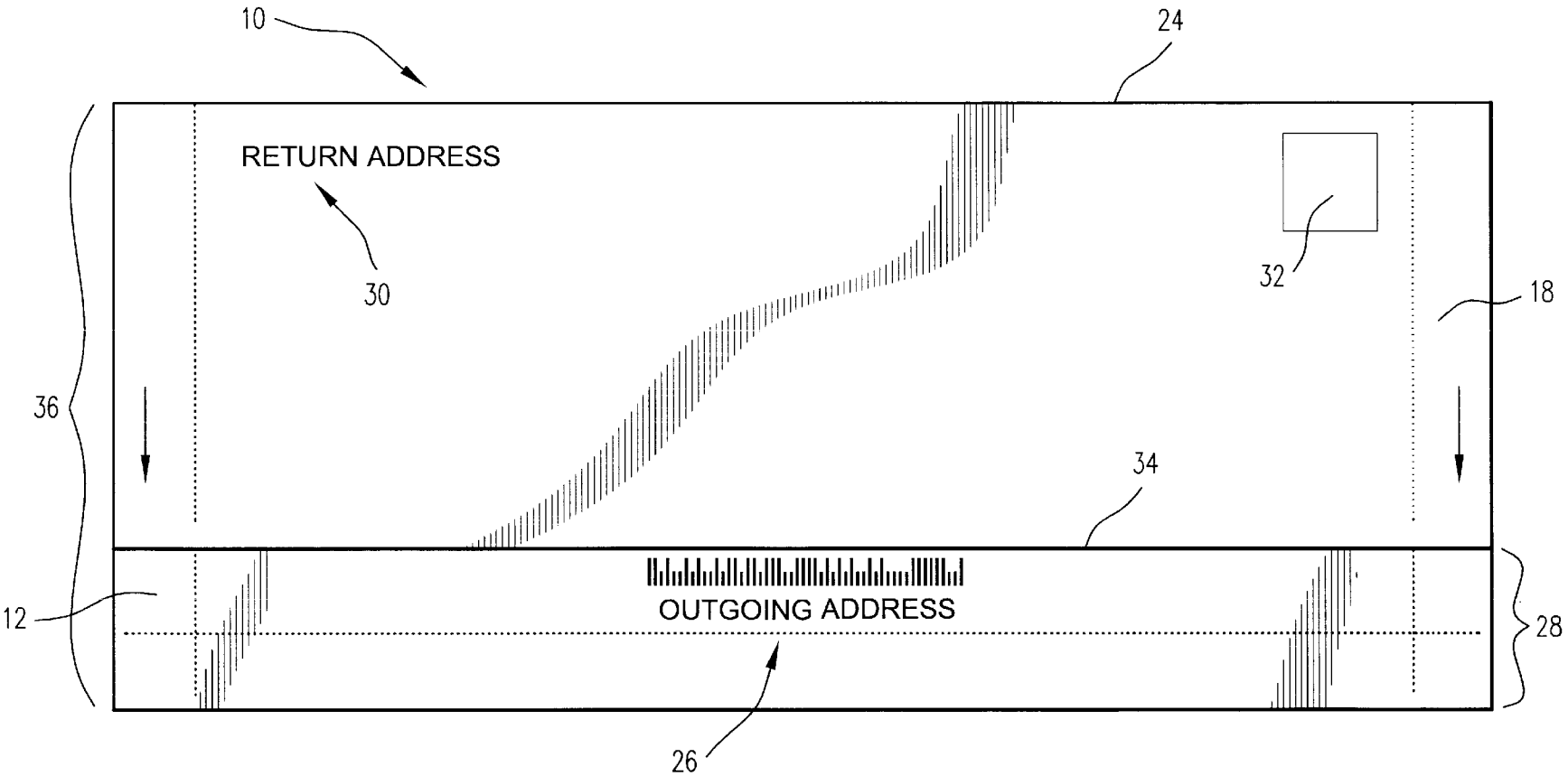
FIG. 2 is a front plan view of the form of FIG. 1 after being folded into a configuration that is ready for mailing.

FIG. 2 shows a front plan view of the mailer form 10 of FIG. 1 after being folded as described above for mailing. As explained above, the front face 36 of the folded mailer form 10 is defined by the back surface of the fourth panel 18 and the lower portion 28 of the first panel 12 containing the outgoing address 26. Thus, FIG. 2 shows the mailer in its substantially flat, folded form for mailing to the location indicated by the outgoing address 26. Any suitable pressure sensitive adhesive or other means of holding the form in the folded condition of FIG. 2 may be used. The adhesive my be provided at any suitable location, such as on the sides of the first and/or fourth panels where these two panels come into contact with one another.

The general mailer form described will now be described with respect to various specific examples of the form, in accordance with the instant invention. In particular, two return envelope embodiments and three non-return envelope embodiments will be described. The two return envelope embodiments include a detachable return stub embodiment and an attached return stub embodiment. The three non-envelope embodiments include a check embodiment, a non-check embodiment and a 180 degree rotated check embodiment. Each of these various embodiments will be described below with reference to FIGS. 3–9. As can be seen in FIGS. 3–9, in all of the embodiments it is preferable that the first fold line 22 is approximately 10.2 inches from the top 52 of the form 10, the second fold line 22 is approximately 6.5 inches from the top 52 of the form, and the third fold line is approximately 2.4 inches from the top 52 of the form. Of course, other fold lines or score lines for enabling other folds or separations to be incorporated into the form 10 may also be provided. However, these three fold lines (20, 22 and 24) as indicated are the primary fold lines and enable the form to be folded in the manner describes herein.

Figure 3:
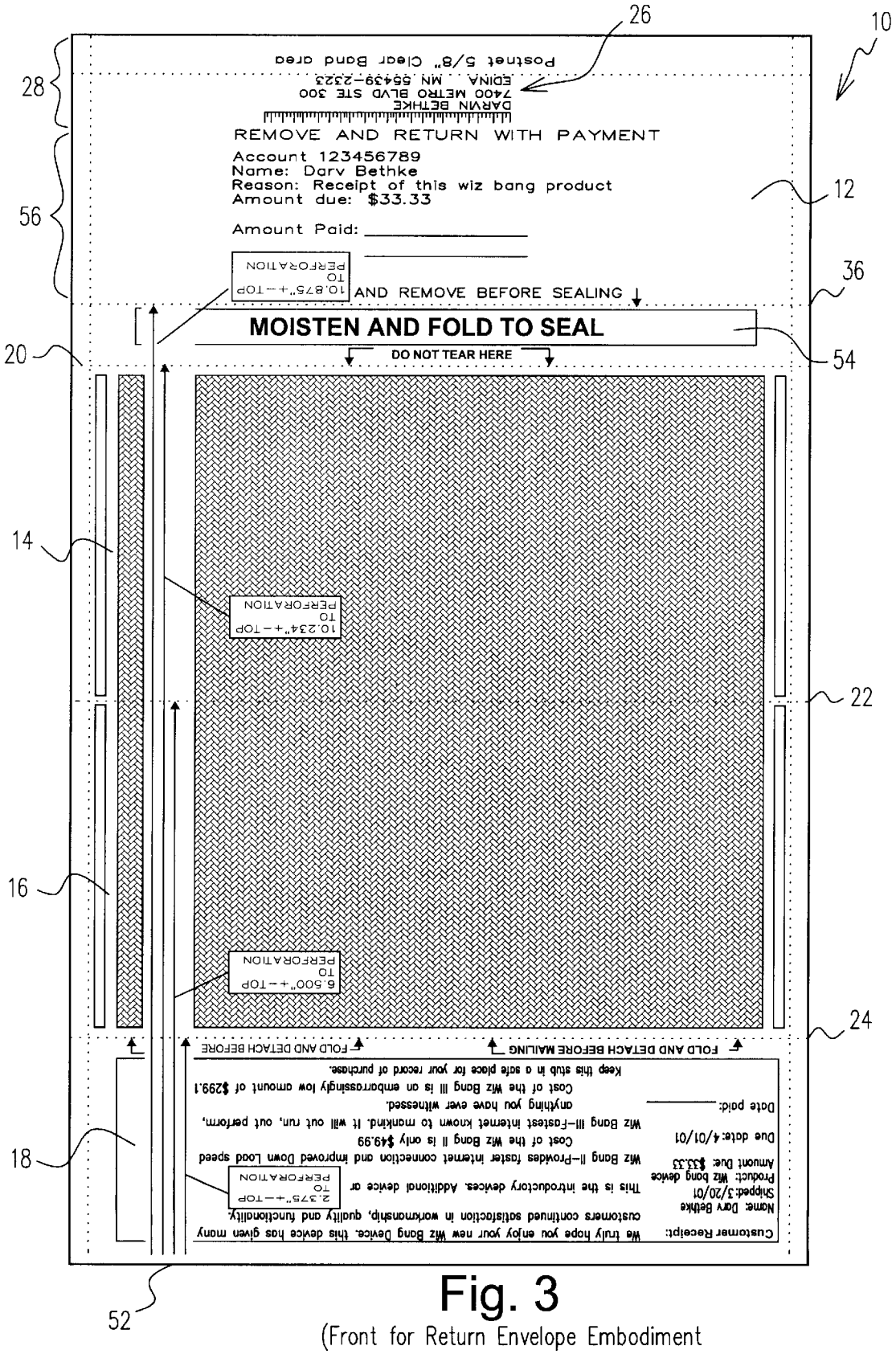
FIG. 3 is a front plan view of a first embodiment of a form constructed in accordance with the instant invention and having a return envelope and detachable return stub.

FIG. 3 shows the front surface of a first embodiment of the instant invention which includes a integral return envelope for use by the recipient of the mailer to send return mail back to the sender of the mailer or another party. In this example, the front surface of the fourth panel 18 includes customer receipt indicia and can be detached from the mailer after opening and prior to returning the mailer back to the sender using the integral return envelope. The second panel 14 and third panel 16 are constructed and configured to define the main portion of the return envelope. Suitable adhesive, such as a pressure sensitive or rewettable adhesive, is provided at, for example, the side edges of the second and third panels for holding the return envelope in a return envelope configuration when the return envelope is folded by the recipient of the mailer for return mailing. A sealing flap 54 with suitable adhesive is also provided as part of the first panel 12 for use in connection with the return envelope feature. A score line 36 is provided for enabling the return envelope to be separated from the remainder of the first panel 12. In this embodiment, the front surface of the first panel also includes a return stub portion 56 that can be detached from the form at line 36.

Figure 4:
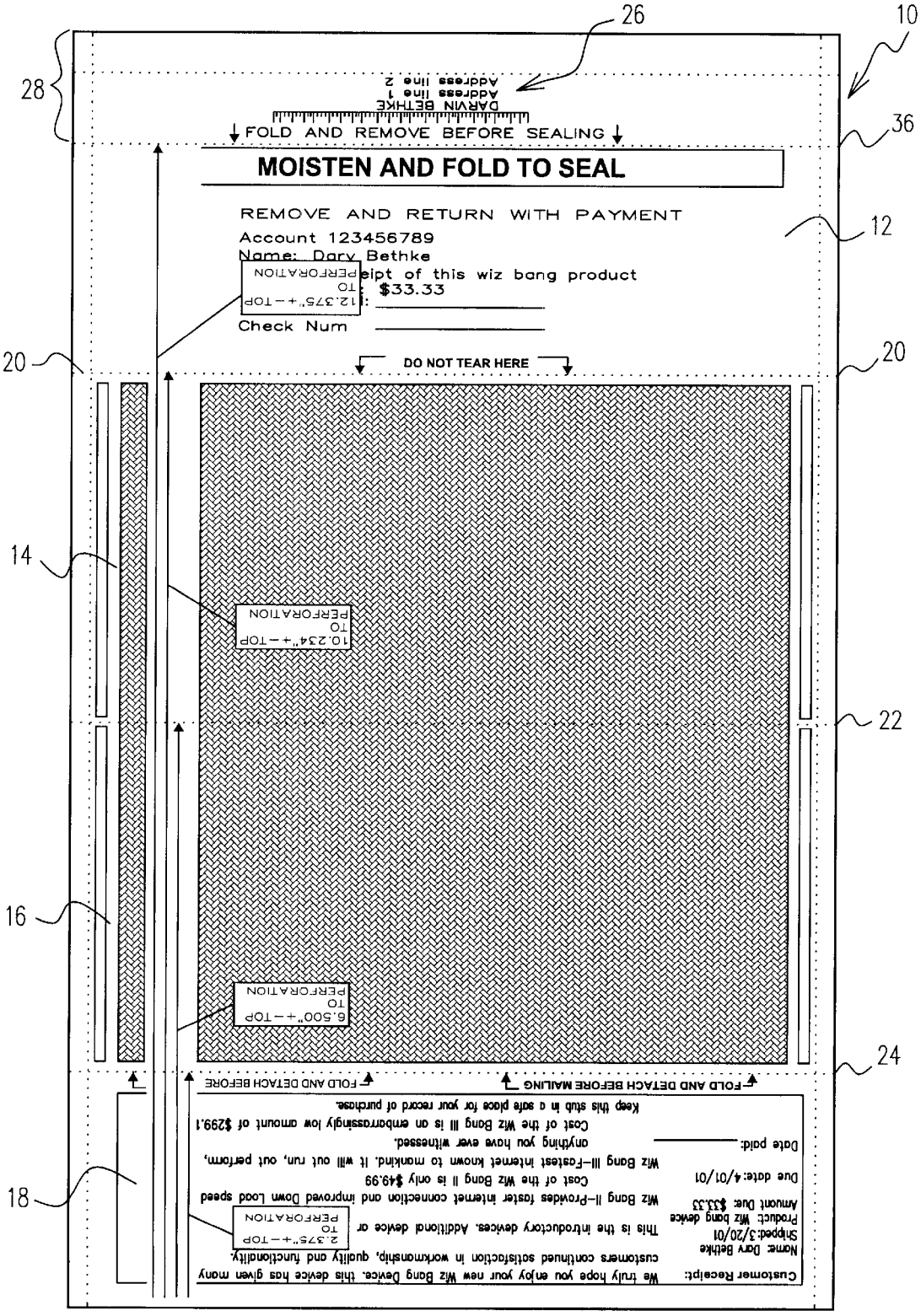
FIG. 4 is a front plan view of a second embodiment of a form constructed in accordance with the instant invention and having a return envelope and an attached return stub.

FIG. 4 shows a front view of an alternative embodiment to that of FIG. 3, which also includes a return envelope. The embodiment of FIG. 4 is similar to that of FIG. 3, except that the first panel 12 is designed such that the return stub remains attached to the form when returning the envelope portion of the form. In other words, the return stub indicia is on the envelope sealing flap, so that it automatically accompanies the return envelope when returned.

Figure 5:
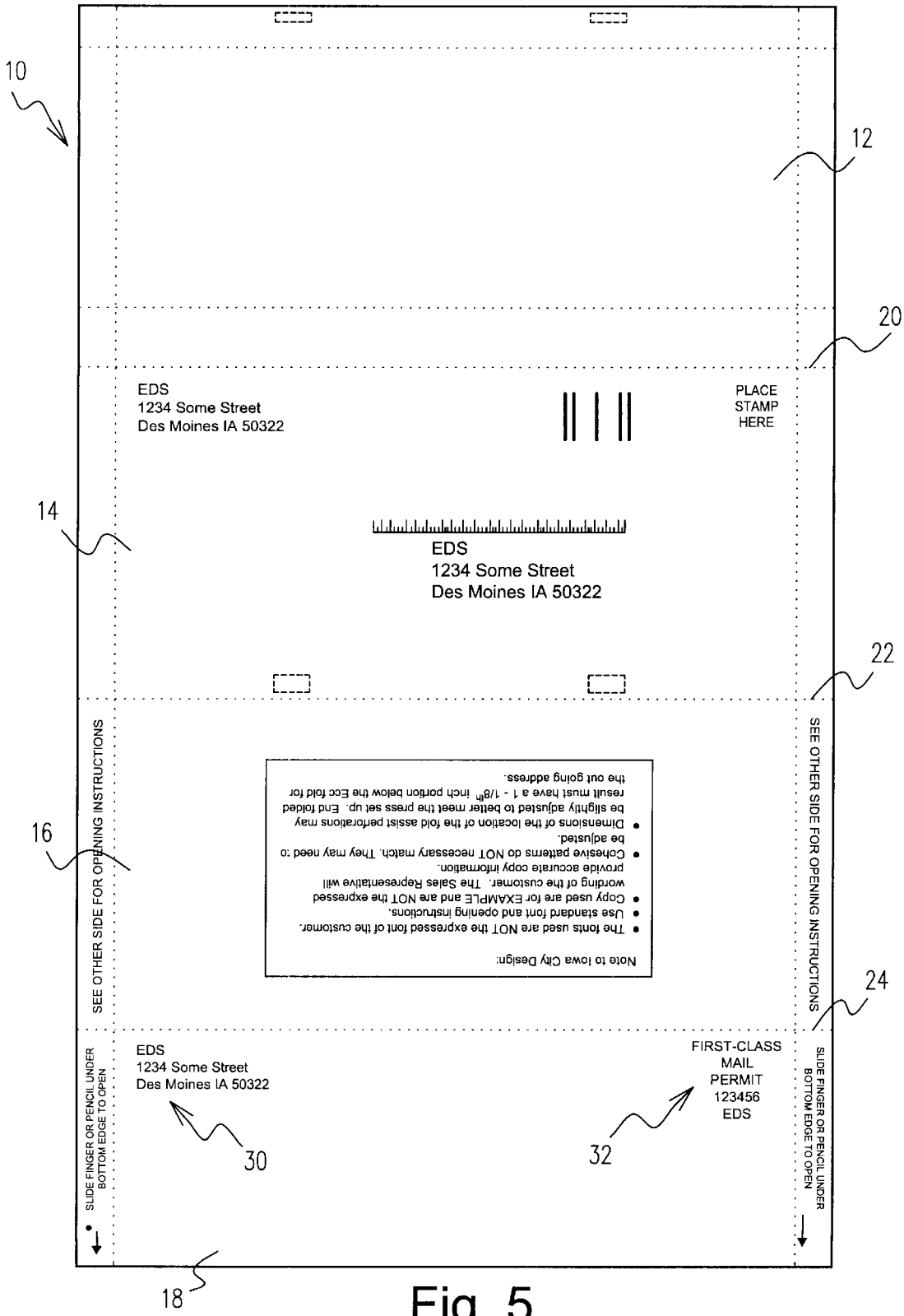
FIG. 5 is a back plan view of the forms shown in the embodiments of FIGS. 4 and 5.

FIG. 5 shows a back view of the embodiments of FIGS. 3 and 4. As can be seen in FIG. 5, the back surface of the fourth panel 18 includes return address indicia 30 for the original mailing, as well as postal information 32. In addition, the back surface of the second panel 14 includes return address information which is visible when the return envelope is configured for return by the recipient of the original mailer. The back surface of the first and third panels may be used for any other purposes depending on the particular application in which the invention is being used.

Figure 6:
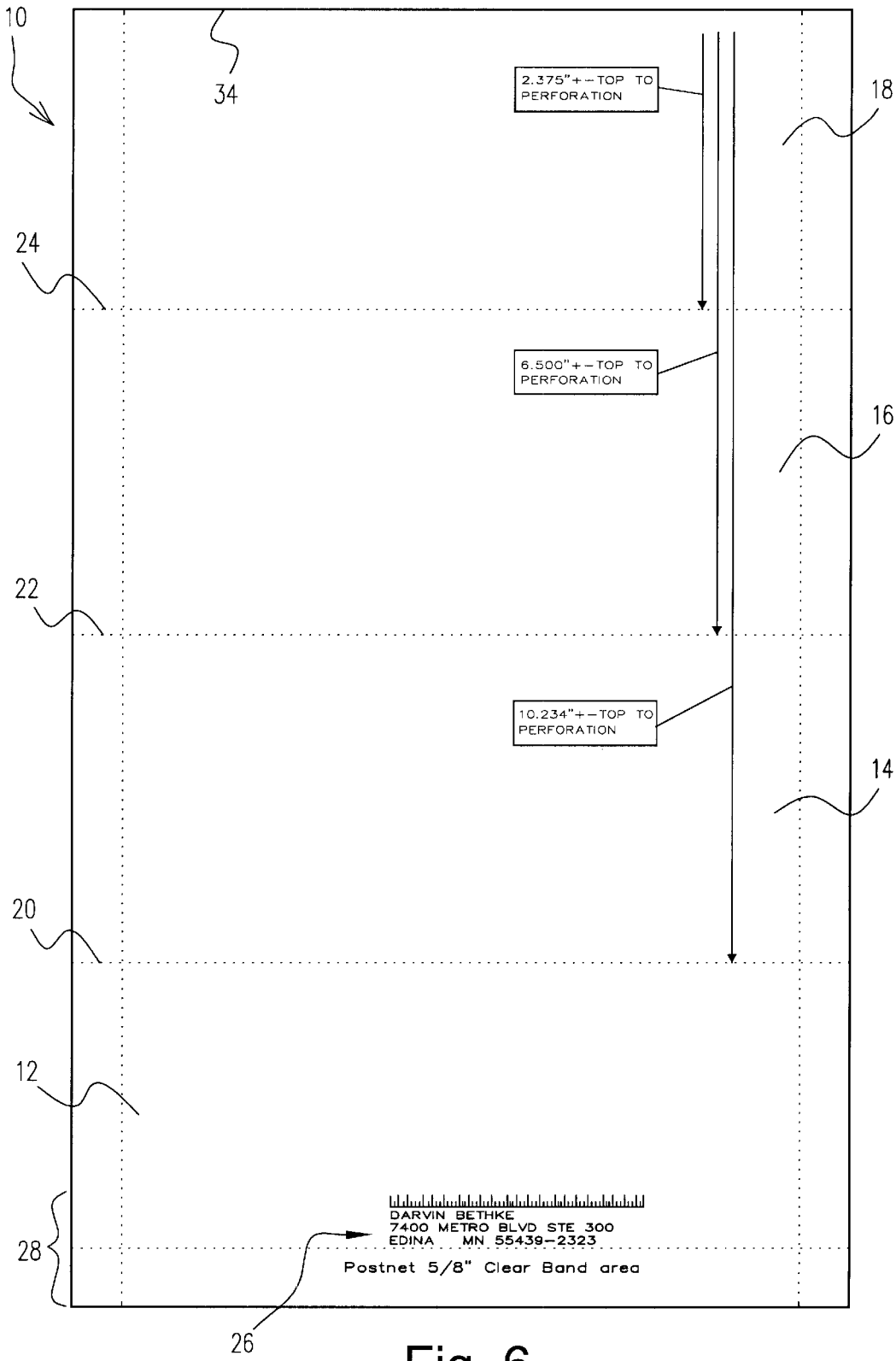
FIG. 6 is a front plan view of a third embodiment (non-check embodiment) of a form constructed in accordance with the instant invention.

FIG. 6 shows a front view of another embodiment of the invention. This embodiment does not include a return envelope. Instead, this embodiment enables substantially the entire form (except the outgoing address portion 28 to be used for customer printed variable information. Thus, this form is the simplest embodiment and can be easily adapted for a variety of non-return envelope applications. Again, this embodiment includes the four panels and three panel fold lines described above, for enabling the form to be folded as described above and as shown in FIGS. 1 and 2.

Figure 7:
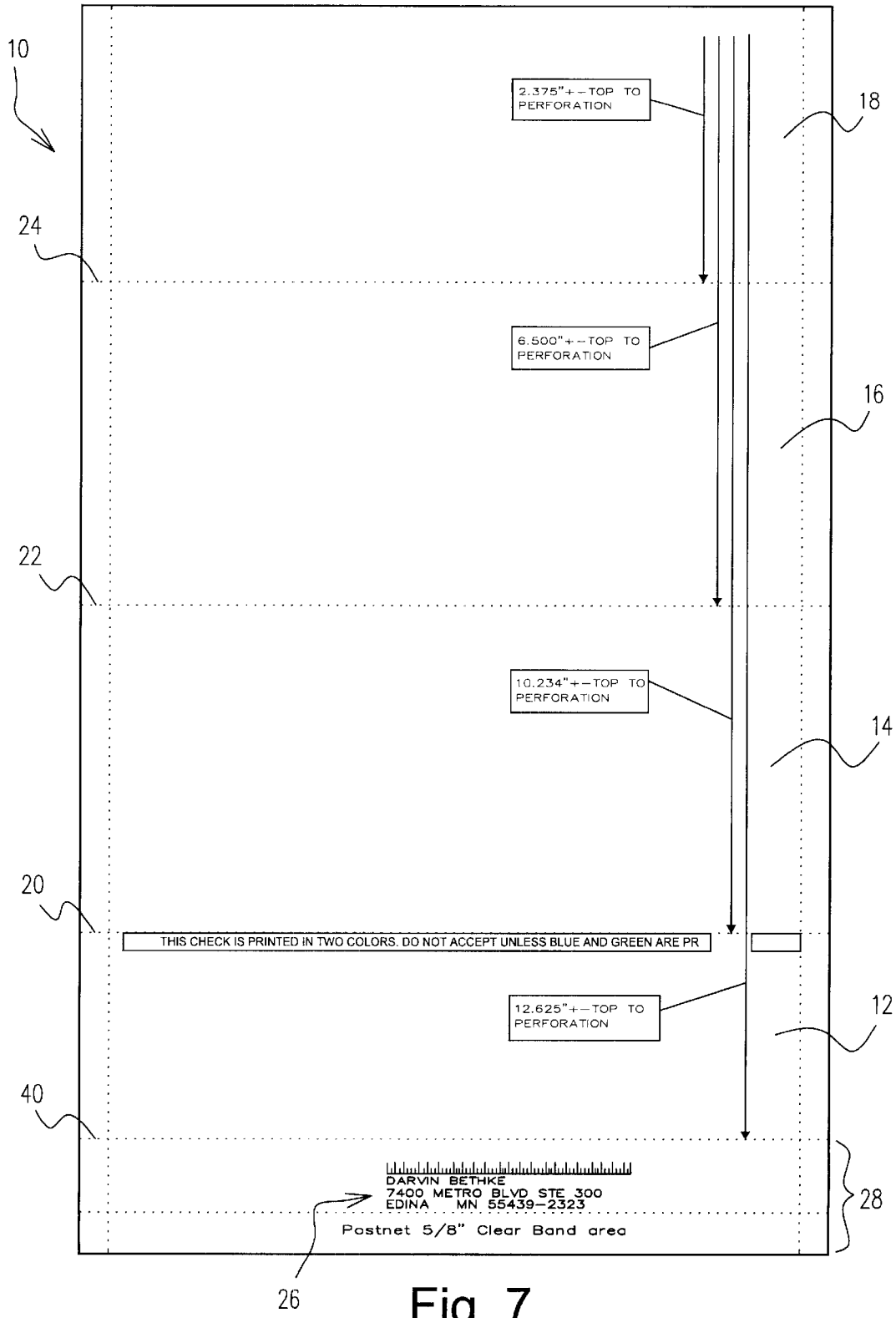
FIG. 7 is a front plan view of a fourth embodiment (check embodiment) of a form constructed in accordance with the instant invention.

FIG. 7 shows a front view of another embodiment of the invention. This embodiment is a check embodiment that also does not include a return envelope. In this embodiment, the front surface of the first panel includes a check that is designed to be sent to the recipient of the mailer. The check uses the upper portion of the first panel 12, i.e., the portion of the check that is not the lower portion of the check used for the outgoing address. The check can be separated from the mailer along score line/fold line 20 after opening the mailer.

Figure 8:
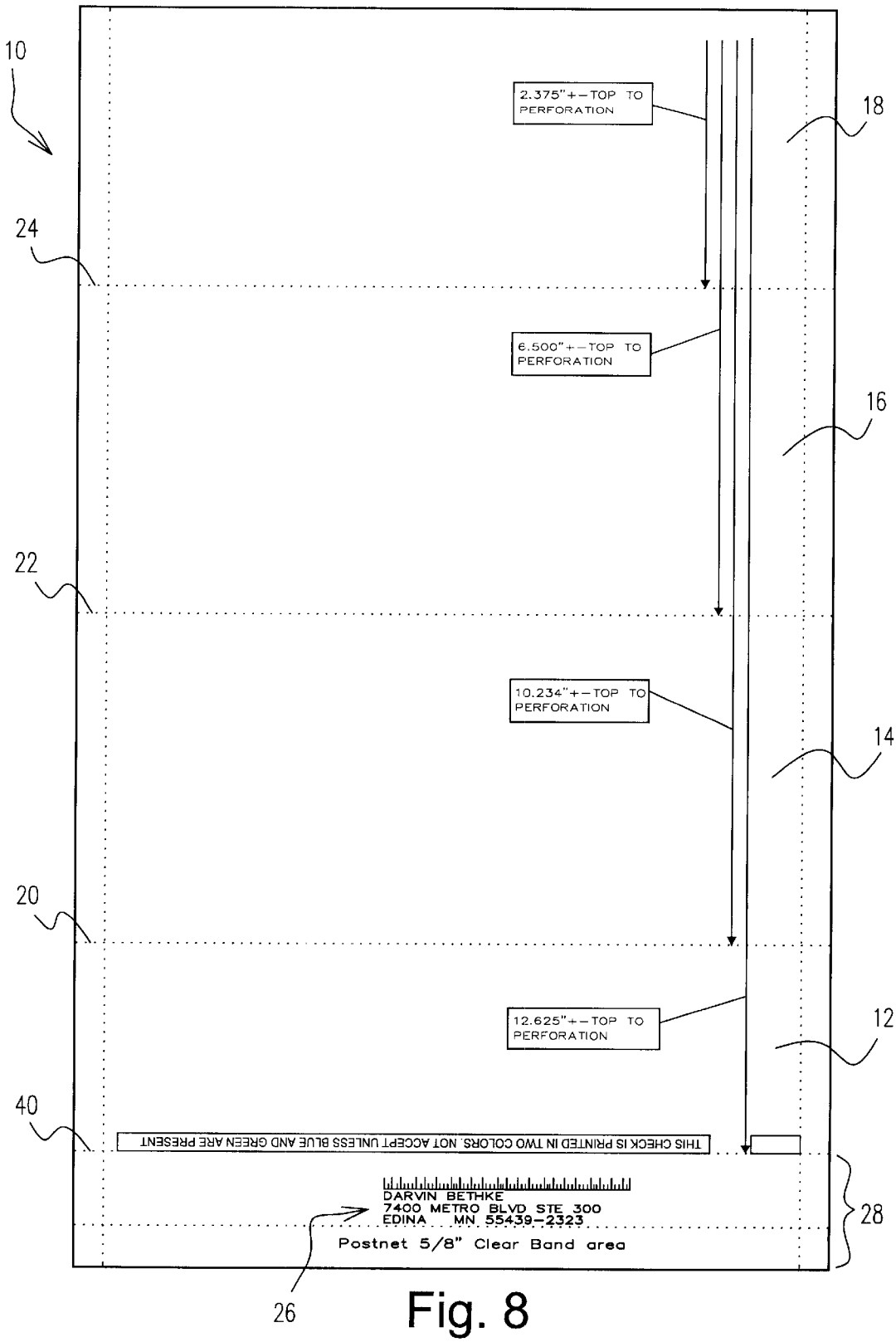
FIG. 8 is a front plan view of a fifth embodiment (180 degree rotated check embodiment) of a form constructed in accordance with the instant invention.

FIG. 8 shows another embodiment of the check embodiment of FIG. 7. In this alternative embodiment, the check is rotated on the form 180 degrees relative to the embodiment of FIG. 7. Other than this difference, this embodiment is substantially the same as the embodiment of FIG. 7. Again, this embodiment includes four main panels (12, 14, 16 and 18) and three score or fold lines (20, 22 and 24) that enables the form to be folded as described above and as shown in FIG. 1 and 2.

Figure 9:
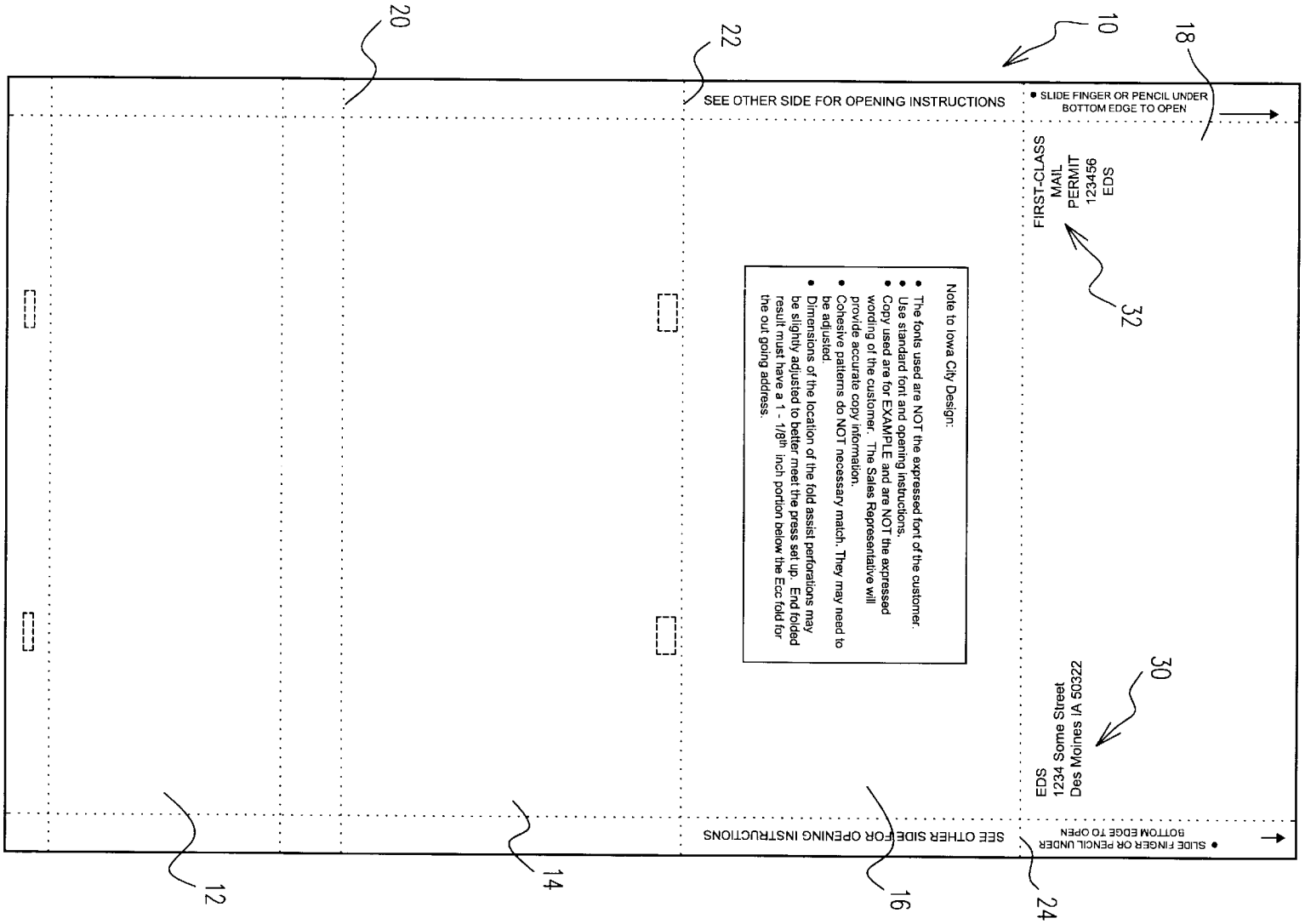
FIG. 9 is a back plan view of the forms shown in the embodiments of FIGS. 6–8).

FIG. 9 shows a back view of the non-envelope embodiments of FIGS. 6–8. As can be seen in FIG. 9, the back surface of the fourth panel includes the return address and postal indicator for the mailer. The back surface of the remaining panels can be used for any suitable purpose depending on the particular application to which the invention is directed.

The following list identifies some of the main features and advantages provided by the various embodiments describes above:

- 7.5"×12.625" useable real-estate for customer printed variable data on Non-Check design
- 7.5"×10.25 useable check statement area with an ANSI X9.xx standard check
- One 7.5"×2.5" and one 7.5"×1.875 detachable customer variable panels on a return envelope with the rewettable glue area abetting the return envelope
- One 7.5"×2.5" detachable with one 7.5×1.875" fixed attached customer variable data panel on the Return Envelope Simplex printed with the rewettable glue area abetting the outgoing address
- Check application with larger statement area
- Highly secure "see through" check with two back and one front panels covering the check
- Easy check removal with 180 deg. Rotated check design. (removes on pre-fold perforation)
- Non-check application with larger customer variable data area
- Built in Return envelope application top open return envelope that is simplex printed. Can be duplex printed
- Built in Return envelope top open simplex printed design is compatible with U.S. Postal and other commercial automatic letter openers
- Re-wettable glue to seal built in return envelope
- Fold and seal in solid sealing roller equipment
- Seal utilizing Pressure Seal Chemistry
- Multiple detached stubs on return envelope
- Attached stub and detached stub on return envelope
- Achieve Postal Automation design
- Cut sheet construction capability
- Continuous Fan Fold construction capability
- Continuous Roll construction capability
- Outgoing document "finger or pencil" opened two small tabs after side tabs removed
- Outgoing check and non-check document single 7.5"×14" sheet after opening
- Adequate space on check, non-check and return envelope constructions to allow integrated labels and removable cards
- Finished piece very simple to use and open
- Easy to understand return correspondence panel management on return envelope
- ANSI X9.xx standard check fits into return envelope without folding the check.

While the preferred forms and embodiment of the instant invention have been illustrated and described above, various changes and/or modification may be made within the scope of the invention as defined by the pending claims, as one skilled in the art will recognize from the description of the invention herein.

What is claimed is:

1. A mailer type business form, comprising:

first, second, third and fourth panels defining a sheet prior to folding said form, each of said panels having a front and back surface, said first, second and third panels being substantially the same size and shape and being interconnected at first and second panel fold lines in a manner that enables the first, second and third panels to be z-folded onto each other;

said first panel including outgoing address indicia on a lower portion of the front surface of the first panel, wherein said lower portion constitutes at least part of a visible portion of a front face of the mailer form when the form is folded and ready for mailing;

said fourth panel being interconnected to said third panel at a third fold line, and further wherein said fourth panel is shorter than said first panel by an amount that causes said fourth panel to extend to a location that is just slightly above the outgoing address indicia on the first panel when folded against said first panel, such that the back surface of said fourth panel and the lower portion of said first panel define the front face of the mailer form; and adhesive for holding the fourth panel against the first panel when the fourth panel is folded onto the first panel, wherein the first panel includes return stub indicia on the front surface thereof above the lower portion having the outgoing address indicia.

2. The mailer type business form of claim 1, wherein the return stub has a score line for enabling the stub to be removed from the mailer form after opening.

3. The mailer type business form of claim 1, wherein the front surface of the second, third and forth panels and the back surface of the first, second and third panels are substantially blank and are provided for customer printed variable information.

4. The mailer type business form of claim 3, wherein the front surface of the first panel above the lower portion defines a removable check.

5. The mailer type business form of claim 3, wherein the front surface of the first panel above the lower portion defines a removable check that is rotated 180 degrees relative to the outgoing address.

6. A mailer type business form, comprising:

first, second, third and fourth panels defining a sheet prior to folding said form, each of said panels having a front and back surface, said first, second and third panels being substantially the same size and shape and being interconnected at first and second panel fold lines in a manner that enables the first, second and third panels to be z-folded onto each other;

said first panel including outgoing address indicia on a lower portion of the front surface of the first panel, wherein said lower portion constitutes at least part of a visible portion of a front face of the mailer form when the form is folded and ready for mailing;

said fourth panel being interconnected to said third panel at a third fold line, and further wherein said fourth panel is shorter than said first panel by an amount that causes said fourth panel to extend to a location that is just slightly above the outgoing address indicia on the first panel when folded against said first panel, such that the back surface of said fourth panel and the lower portion of said first panel define the front face of the mailer form; and adhesive for holding the fourth panel against the first panel when the fourth panel is folded onto the first panel;

wherein the second and third panels are configured to constitute at least part of a return envelope for the mailer form.

7. The mailer type business form of claim 6, wherein the back surface of the second panel includes return address information.

8. A mailer type business form, comprising:

first, second, third and fourth panels defining a sheet prior to folding said form, each of said panels having a front and back surface, said first, second and third panels being substantially the same size and shape and being interconnected at first and second panel fold lines in a manner that enables the first, second and third panels to be z-folded onto each other;

said first panel including outgoing address indicia on a lower portion of the front surface of the first panel, wherein said lower portion constitutes at least part of a visible portion of a front face of the mailer form when the form is folded and ready for mailing;

said fourth panel being interconnected to said third panel at a third fold line, and further wherein said fourth panel is shorter than said first panel by an amount that causes said fourth panel to extend to a location that is just slightly above the outgoing address indicia on the first panel when folded against said first panel, such that the back surface of said fourth panel and the lower portion of said first panel define the front face of the mailer form; and adhesive for holding the fourth panel against the first panel when the fourth panel is folded onto the first panel;

wherein the front surface of the fourth panel includes customer receipt indicia.

9. A mailer type business form, comprising:

first, second, third and fourth panels defining a sheet prior to folding said form, each of said panels having a front and back surface, said first, second and third panels being substantially the same size and shape and being interconnected at first and second panel fold lines in a manner that enables the first, second and third panels to be z-folded onto each other;

said first panel including outgoing address indicia on a lower portion of the front surface of the first panel, wherein said lower portion constitutes at least part of a visible portion of a front face of the mailer form when the form is folded and ready for mailing;

said fourth panel being interconnected to said third panel at a third fold line, and further wherein said fourth panel is shorter than said first panel by an amount that causes said fourth panel to extend to a location that is just slightly above the outgoing address indicia on the first panel when folded against said first panel, such that the back surface of said fourth panel and the lower portion of said first panel define the front face of the mailer form; and adhesive for holding the fourth panel against the first panel when the fourth panel is folded onto the first panel;

wherein the lower portion of the first panel encompasses approximately the lower 1.125 inches of the first panel;

wherein the first panel includes return stub indicia on the front surface thereof above the lower portion having the outgoing address indicia.

10. The mailer type business form of claim 9, wherein the fourth panel extends to approximately 1.125 inches from the bottom of the first panel when folded thereon.

11. The mailer type business form of claim 10, wherein the return stub has a score line for enabling the stub to be removed from the mailer form after opening.

12. The mailer type business form of claim 10, wherein the second and third panels are configured to constitute at least part of a return envelope for the mailer form.

13. The mailer type business form of claim 10, wherein the front surface of the fourth panel includes customer receipt indicia.

14. The mailer type business form of claim 10, wherein the back surface of the second panel includes return address information.

15. The mailer type business form of claim 10, wherein the front surface of the second, third and forth panels and the back surface of the first, second and third panels are substantially blank and are provided for customer printed variable information.

16. The mailer type business form of claim 15, wherein the front surface of the first panel above the lower portion defines a check.

17. The mailer type business form of claim 15, wherein the front surface of the first panel above the lower portion defines a check that is rotated 180 degrees relative to the outgoing address.

18. A mailer type business form, comprising:

first, second, third and fourth panels, each of said panels having a front and back surface, said first, second and third panels being substantially the same size and shape and being interconnected at first and second panel fold lines in a manner that enables the first, second and third panels to be z-folded onto each other;

said first panel including outgoing address indicia on a lower portion of the front surface of the first panel, wherein said lower portion constitutes at least part of a visible portion of a front face of the mailer form when the form is folded and ready for mailing;

said fourth panel being interconnected to said third panel at a third fold line, and further wherein said fourth panel is shorter than said first panel by an amount that causes said fourth panel to extend to a location that is just slightly above the outgoing address indicia on the first panel when folded against said first panel, such that the back surface of said fourth panel and the lower portion of said first panel define the front face of the mailer form; and adhesive for holding the fourth panel against the first panel when the fourth panel is folded onto the first panel;

wherein the first, second, third and fourth panels define a sheet prior to folding said form, said first panel fold line being approximately 10.2 inches from the top of the sheet, said second panel fold line being approximately 6.5 inches from the top of the sheet, and said third fold line being approximately 2.4 inches from the top of the sheet, and further wherein the first panel includes return stub indicia on the front surface thereof above the lower portion having the outgoing address indicia.

* * * * *